US006448502B2

(12) United States Patent
Reynolds et al.

(10) Patent No.: US 6,448,502 B2
(45) Date of Patent: Sep. 10, 2002

(54) LEAD WIRE FOR OXYGEN SENSOR

(76) Inventors: Kim A. Reynolds, 453 Lantern La., Berwyn, PA (US) 19312; John K. Pratt, 153 W. Washington Ave., Washington, NJ (US) 07882

( * ) Notice: Subject to any disclaimer, the term of this patent is extended or adjusted under 35 U.S.C. 154(b) by 0 days.

(21) Appl. No.: 09/795,659

(22) Filed: Feb. 28, 2001

Related U.S. Application Data

(60) Provisional application No. 60/186,078, filed on Feb. 29, 2000.

(51) Int. Cl.[7] ..... H01B 5/10

(52) U.S. Cl. ..... 174/128.1

(58) Field of Search ..... 174/128.1, 128.2; 204/424; 73/23.1

(56) References Cited

U.S. PATENT DOCUMENTS

| | | | | | |
|---|---|---|---|---|---|
| 1,904,116 | A | * | 4/1933 | Baum | 174/128.1 |
| 2,098,163 | A | * | 11/1937 | Reed | 174/128.1 |
| 4,349,694 | A | * | 9/1982 | ViVes | 174/128.1 |
| 4,689,444 | A | * | 8/1987 | Burgess | 174/128.1 |
| 5,290,421 | A | | 3/1994 | Reynolds et al. | 204/424 |
| 5,696,352 | A | * | 12/1997 | Kourimsky | 174/126.3 |
| 5,969,229 | A | | 10/1999 | Hori et al. | 73/23.31 |

* cited by examiner

*Primary Examiner*—Chau N. Nguyen
(74) *Attorney, Agent, or Firm*—Synnestvedt & Lechner LLP

(57) ABSTRACT

A lead wire for use with an oxygen sensor is disclosed. The wire is formed of a center strand having high tensile strength surrounded by a first plurality of strands having high electrical conductance. Further pluralities of strands having high tensile strength or high electrical conductance surround the center strand and the first plurality of strands.

8 Claims, 3 Drawing Sheets

LEAD WIRE FOR OXYGEN SENSOR

CROSS REFERENCE TO RELATED APPLICATION

This application is based on and claims the benefit of prior filed provisional Application No. 60/186,078, filed Feb. 29, 2000 now abandoned.

FIELD OF THE INVENTION

This invention relates to lead wires for use with oxygen sensors and especially to lead wires formed from multiple strands made of different materials.

BACKGROUND AND OBJECTS OF THE INVENTION

Internal combustion engines, and particularly automotive-type internal combustion engines, produce exhaust gases which include carbon monoxide, unburned or partially burned hydrocarbons and nitrogen oxides. These materials are undesirable byproducts of the combustion process, and their presence in the exhaust gases can be substantially reduced by proper control of combustion conditions. One condition which is important in establishing efficient combustion and hence reduced levels of pollutants in the exhaust gas is the amount of air provided to the combustion process. The amount of air introduced into the combustion chamber is frequently controlled by systems which first require determining the oxygen content in the exhaust gas. This information is then utilized to control the respective amounts of fuel and air being supplied to the engine so that the exhaust gases will have the desired combustion. Thus, electrochemical sensors have heretofore frequently been used as part of electrical systems in automobiles for measuring and controlling the composition of exhaust gases. One such sensor is disclosed in U.S. Pat. No. 5,290,421 to Reynolds et al, which is hereby incorporated by reference.

Such sensors typically utilize a solid electrolyte to determine the oxygen concentration in the exhaust gases. The electrolyte typically comprises an oxygen-ion-conductive tube or cone having an electrode on the outer and inner surfaces thereof. The outer surface of the sensor is exposed to the exhaust gases and the interior of the sensor is provided with a reference source of oxygen, such as ambient air. In operation, the differential in oxygen concentration between the exhaust gases and the reference source causes conduction of oxygen ions through the ion-conductive body, resulting in an electrical current which is dependent upon the relative content of oxygen in the exhaust gas and the reference source.

In order to fully activate the solid electrolyte of such sensors and to obtain an appreciable output voltage for measuring oxygen concentration, the sensor element must be heated to an elevated temperature. It has frequently been common practice to rely upon the heat of the exhaust gases passing over the outer electrode to cause the necessary increase in the temperature of the sensor element. However, this procedure has a drawback, namely, such arrangements result in a sensor that is essentially inoperative or only marginally operative, during the warm-up period of the internal combustion engine; yet, it is during this warm-up period that the concentration of pollutants in the exhaust gases is the highest. In order to overcome this disadvantage, oxygen sensors are provided with an electrical heating element for rapidly increasing the temperature of the sensor.

Thus, oxygen sensors require electrically-conductive pathways to carry: (1) the electrical current which is proportional to the oxygen concentration in the exhaust gases in a feedback loop to the control system which determines the fuel/air ratio supplied to the engine; and (2) the electrical current which powers the heating element allowing the oxygen sensor to operate effectively during the transient engine warm-up period.

The conductive pathways are provided by oxygen sensor lead wires. The lead wires are subject to extremely harsh environmental conditions. They must run between the exhaust system of an automobile and the engine compartment and are, thus, subject to extremes of heat, cold, vibration, tensile and compression forces and abuse from roadway hazards, yet they must maintain electrical continuity, ideally for the operational life of the vehicle, to ensure that the signals from the oxygen sensor are communicated to the control system with the utmost fidelity and that the heating element receives the necessary power to maintain the sensor at the required operating temperature during the critical warm-up period of engine operation.

To meet the harsh environmental and performance demands, lead wires for oxygen sensors have developed into multi-strand wires having various strands of different material types in order to provide the flexibility, robustness, strength and long fatigue life required for effective operation. The conventional wisdom teaches that these characteristics can be best achieved by increasing the number of strands while decreasing the gage of each strand. For example, lead wires having 37 strands are not uncommon, and lead wires having over 100 strands are also in production.

While multi-strand lead wires developed according to the conventional theories do exhibit the characteristics necessary for effective use with oxygen sensors, such lead wires suffer from a tremendous cost disadvantage in that they are complicated, expensive and difficult to produce. Production is expensive because with increasing numbers of strands, it becomes more difficult to lay them together in one pass through the wire laying machines, thus, requiring multiple passes which increase the production time required. Wires having more and finer strands are also more prone to the phenomenon of "birdcaging" a failure mode which occurs during production when the wire is subjected to compression forces and the strands splay outwardly to form a cage-like expansion of a section of the wire. Birdcaging can result in a "high strand", an individual strand which extends outwardly from the multi-strand wire further than the other strands comprising the wire. The projecting strand often becomes caught on a piece of machinery or a die during production, and the strand is stripped from the wire as the wire passes through the machine, eventually forming a tangled mass of strand and forcing a shutdown of the production line and scrapping of a significant length of the wire produced. The increased propensity for birdcaging also limits the speed at which the wire laying machinery can be operated, in order to keep the forces placed on the wire low and avoid birdcaging or other failures.

Another disadvantage of traditional multi-strand lead wires is that such wires tend to yield and take a permanent set when packaged on a spool or drum. The wire must later be straightened so that it can be attached to the oxygen sensor or other terminals, usually by automated crimping machines. The straightening process adds a step which increases the cost and decreases the rate of production. The straightening process also subjects the wire to potential damage in that the adhesion between the insulating layer and the wire can be disrupted, allowing significant lengths of the insulation to separate from the wire, rendering the wire worthless and, thus, lowering production efficiency.

Yet another disadvantage of traditional multi-strand lead wires is their "notch sensitivity" or lack of toughness in resisting physical damage without developing indentations, cracks or other flaws, usually in the outermost strands comprising the wire. Notch sensitivity is important because any flaws in the wire strands serve as stress risers and crack initiation points from which cracks propagate and cause premature fatigue failure of the strands when the wire is subjected to reverse bending stresses as experienced, for example, in a high vibration environment. As individual strands fail in fatigue, the stress is shared by an ever decreasing number of remaining strands, thus, increasing the stress on the strands and accelerating the fatigue failure of the wire. Multi-strand wires having relatively soft nickel plated copper strands in the outermost layer are particularly notch sensitive. Damage to the wire can hardly be avoided, and can occur during the production process, during installation or in use. Crimping of the wires to form electrical connections can be especially damaging to the outer wire layer and can shorten the fatigue life of the wire dramatically.

Clearly, there is a need for an improved oxygen sensor lead wire which can meet the harsh environmental conditions and performance demands but which is simple and inexpensive to produce.

SUMMARY AND OBJECTS OF THE INVENTION

The invention concerns a lead wire for use with an oxygen sensor. Preferably, the lead wire comprises an elongate center strand having a relatively high tensile strength and a first plurality of elongate strands arranged circumferentially around the center strand, each strand of the first plurality having a relatively high electrical conductance.

A second plurality of elongate strands, each having a relatively high electrical conductance, along with a third and a fourth plurality of elongate strands, each having a relatively high tensile strength, are arranged circumferentially around the first plurality of strands in a repeating pattern, wherein each strand of the second plurality is positioned substantially between a strand of the third plurality and a strand of the fourth plurality. The strands of the third and fourth pluralities are made of first and second materials which are different from one another.

Preferably, the center strand is stainless steel, the strands of the first and second pluralities are nickel plated copper, the strands of the third plurality are soft stainless steel and the strands of the fourth plurality are hard stainless steel.

The invention also concerns an oxygen sensor lead wire again comprising an elongate center strand having a relatively high tensile strength and a first plurality of elongate strands arranged circumferentially around the center strand, each strand of the first plurality having a relatively high electrical conductance.

The wire further comprises a second plurality of elongate strands having a relatively high electrical conductance and a third plurality of elongate strands having a relatively high tensile strength. The strands of the second and third pluralities are arranged circumferentially around the first plurality of strands in a repeating pattern wherein two strands of the second plurality are positioned substantially between two strands of the third plurality, and two strands of the third plurality are positioned in between two strands of the second plurality.

It is an object of the invention to provide an oxygen sensor lead wire which has a high tensile strength and fatigue life.

It is another object of the invention to provide an oxygen sensor lead wire comprised of a minimum of strands.

It is yet another object of the invention to provide a lead wire with a relatively low notch sensitivity which can resist physical damage and avoid flaws which result in stress risers which cause premature fatigue failure of the wire.

It is again another object of the invention to provide an oxygen sensor lead wire which can be formed in one pass through automated wire laying machinery.

It is yet another object of the invention to provide a lead wire which is less prone to birdcaging failure.

It is still another object of the invention to provide a lead wire which is less prone to the high strand condition and its associated failure.

It is yet another object of the invention to provide a lead wire which allow the wire laying machinery to run at higher speeds.

It is also another object of the invention to provide a lead wire which is less prone to take on a permanent set when wound around a spool or drum.

These and other objects of the invention will become apparent from a consideration of the following drawings and detailed description of a preferred embodiment of the invention.

DETAILED DESCRIPTION OF PREFERRED EMBODIMENTS

Figure 1:
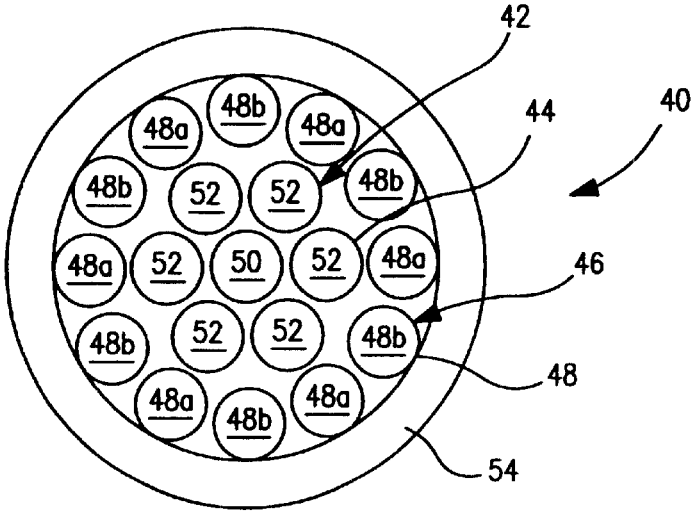
FIG. 1 shows a cross-sectional view of a lead wire according to the invention.

FIG. 1 shows a cross-sectional view of a lead wire 40 according to the invention for use with an oxygen sensor. Lead wire 40 comprises an inner core 42 formed of a first plurality of elongate strands 44 and an outer layer 46 formed of a second plurality of elongate strands 48. The second plurality of strands 48 can be divided into a first group of strands 48*a* made of a first material and a second group of strands 48*b* made of a second material.

FIG. 1 illustrates an embodiment of the lead wire according to the invention formed of 19 strands of number 32 AWG wires. The first plurality of elongate strands 44 forming the inner core 42 preferably comprise seven strands, a center strand 50 and six surrounding strands 52 arranged circumferentially around the center strand 50. The second plurality of strands 48 forming the outer layer .46 preferably comprises 12 strands arranged circumferentially surrounding the inner core 42. A sheath 54, preferably made of PTFE, surrounds the outer layer 46 forming a protective and insulating cover for the lead wire 40. Together, the inner core and the outer layer form a lead wire of number 20 AWG.

In the embodiment of FIG. 1, strands 48*a* of the first group are formed of a copper alloy and are plated with a layer of nickel between about 40 and 100 micro-inches in thickness and preferably about 80 micro-inches thick. The reason for the nickel plate is explained below. Strands 48*b* of the second group are formed of stainless steel and are arranged in an alternating fashion wherein each strand 48*a* of the first group is positioned between two strands 48*b* of the second group. Strands 52 forming the inner core 42 are preferably nickel plated copper similar to strands 48*a*, and the center strand 50 is stainless steel.

Numerous variations of the aforementioned embodiment are possible without departing from the invention as contemplated. For example, center strand 50 can be made of either soft stainless steel or hard stainless steel of alloys, such as AISI 304 or 302. Strands 48*b* of the outer layer can also be formed of either soft or hard stainless steel or a combination of both materials.

Figure 2:
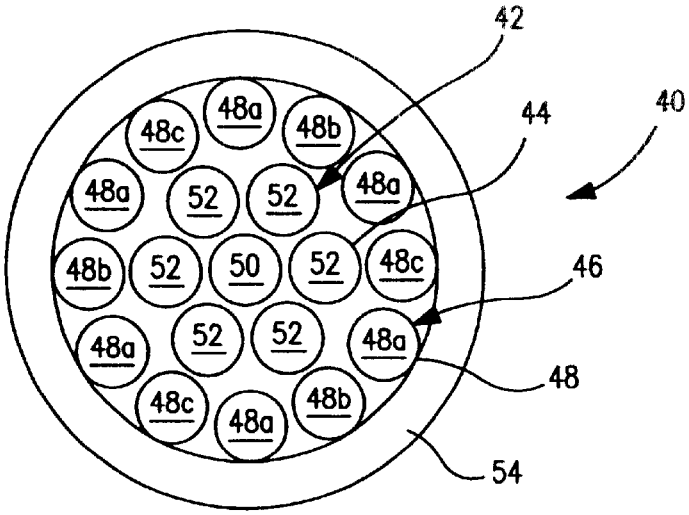
FIG. 2 shows a cross-sectional view of a preferred embodiment of a lead wire according to the invention.

FIG. 2 shows a preferred embodiment of an oxygen sensor lead wire according to the invention, wherein the outer layer 46 is formed of a combination of nickel plated copper strands 48*a*, soft stainless steel strands 48*b* and hard stainless steel strands 48*c*. The strands of the outer layer are preferably arranged in a repeating pattern (shown in FIG. 2) of a nickel plated copper strand 48*a*, a soft stainless steel strand 48*b*, another nickel plated copper strand 48*a* and a hard stainless steel strand 48*c*. As noted above, the center strand 50 is hard or soft stainless steel and the six surrounding strands 52 of the inner core 42 are nickel plated copper.

Figure 3:
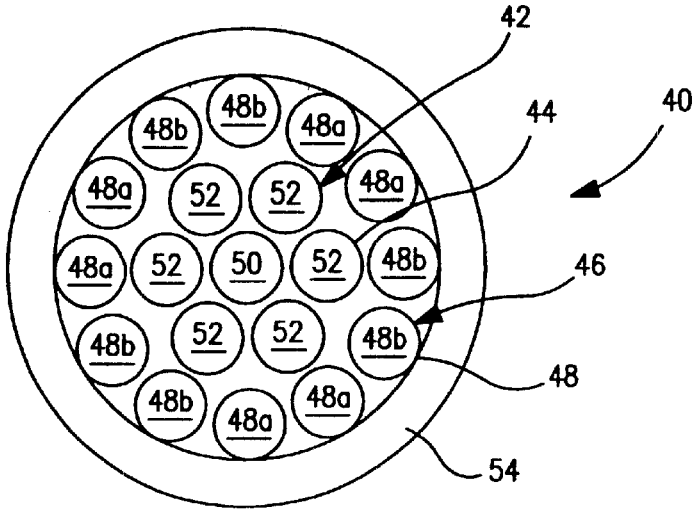
FIG. 3 shows a cross-sectional view of another preferred embodiment of a lead wire according to the invention.

FIG. 3 illustrates another preferred embodiment of a lead wire 40 according to the invention, wherein outer layer 46 is again formed of two groups of strands of different materials, preferably strands 48*a* of nickel plated copper and strands 48*b* of stainless steel (either hard or. soft stainless steel), but arranged in a repeating pattern of two adjacent strands 48*a* of nickel plated copper followed by two adjacent strands of stainless steel 48*b* (hard or soft) as shown. The inner core 42 is again formed of nickel plated copper strands 52 surrounding center strand 50, which is hard or soft stainless steel.

Figure 4:
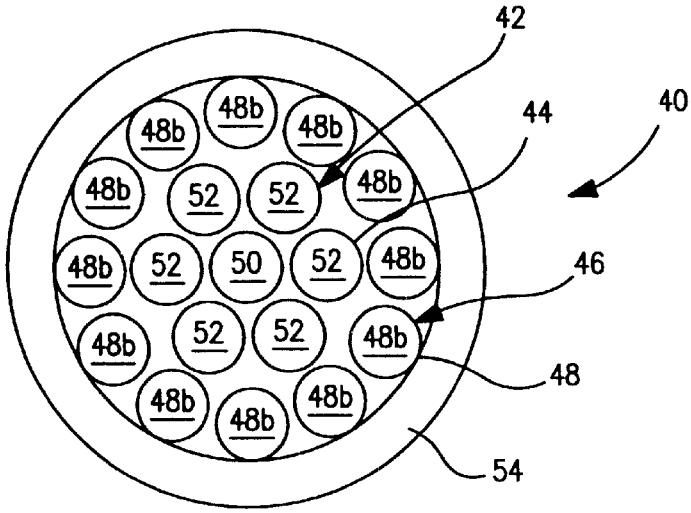
FIG. 4 shows a cross-sectional view of an alternate embodiment of a lead wire according to the invention.

FIG. 4 illustrates another embodiment of a lead wire 40 according to the invention, wherein the outer layer 46 is formed entirely of stainless steel strands 48*b*. The stainless steel could be hard or soft. This embodiment produces exceedingly tough wire with extremely low notch sensitivity and can be expected not to suffer from premature fatigue failure caused by damage to the strands, for example, as when the wire is crimped. The center strand 50 and the surrounding strands 52 of the inner core 42 are all made of nickel plated copper and are well protected by the surrounding stainless steel strands 48*b* comprising the outer layer 46. Because there are more stainless strands in this embodiment as compared to the aforementioned embodiments (twelve versus seven), it is also expected that this embodiment will have a higher tensile strength and will also be stiffer in bending.

The preferred embodiments, as well as the alternate embodiments, are preferably formed with the inner core and the outer layer having the same length and direction of lay, the specific lay length being between about 0.4 to 0.6 inches and preferably about 0.493 inches. Other lay configurations are also possible, however. For example, the inner core could have a larger or smaller specific lay length than the outer layer, and/or the direction of the lay could be different, with the inner layer having an opposite twist from the outer layer.

Manufacturing Process

The preferred machinery for the manufacture of multi-strand lead wire according to the invention is a "tubular"-type wire strander, so named because it features a rotating tube which is used to impart twist to the wire as described below. The strander has at least 19 separate positions or "bays", each one of which accommodates one spool which feeds one of the 19 strands comprising the wire to the machine. In operation, the individual strands come off the spools and are guided lengthwise along the surface of the rotating tube through guides fixed to the tube. The strands are then directed through fixed positioning guides at the downstream end of the tube into one or more forming dies. The strands are brought together by the forming die or dies, thereby forming the multi-stranded lead wire. Twist is imparted to the strands as they are brought together by the forming die or dies by continuous rotation of the tube about its longitudinal axis as the strands pass along the tube. Capstans, located downstream of the forming die or dies, pull the strands through the forming die or dies. The rate at which the capstans pull the strands, in conjunction with the rate at which the tube is rotated, establishes the lay length of the wire. A take-up mechanism arranged downstream of the capstans has a take-up reel which is rotated at the appropriate rate to pull the wire onto reel as the wire is made, maintaining constant tension on the wire at all times.

The position of reels of strand in the stranding machine must allow for proper alignment of the strands as they are fed to the machine in order to ensure the proper relative placement of each strand in the wire. It is important that each strand be correctly located in the proper positioning guide in order to establish and maintain correct strand positioning throughout the manufacturing process. The strands 50 and 52 of the inner core 42, as well as the strands 48 of the outer layer 46, are directed through stranding dies located at the point where the strands converge. The stranding dies serve to help maintain correct strand position, establish uniform surface condition of the wire and control the overall lead wire diameter.

Advantages of the Invention

The lead wire constructed according to the invention provides significant advantages in physical properties, manufacturing and during use over many commonly used prior art lead wires as described below for two prophetic examples.

Prophetic Example No. 1

As shown in FIG. 2, a center strand 50 of stainless steel is circumferentially surrounded by 6 strands 52 of nickel plated copper, which are circumferentially surrounded by a further 12 strands, 6 strands 48*a* being nickel plated copper, 3 strands 48*b* being soft stainless steel and 3 strands 48*c* being hard stainless steel. The outer 12 strands are arranged in a repeating pattern having a nickel plated copper strand 48*a* adjacent to a soft stainless steel strand 48*b*, which is adjacent to another nickel plated copper strand 48*a*, followed by a hard stainless steel strand 48*c*. All strands are number 32 AWG producing a lead wire of number 20 AWG.

Prophetic Example No. 2

As shown in FIG. 3, a center strand 50 of stainless steel is circumferentially surrounded by 6 strands 52 of nickel plated copper, which are circumferentially surrounded by a further 12 strands, 6 strands 48*a* being nickel plated copper and 6 strands 48*b* being stainless steel, either hard or soft. The outer 12 strands are arranged in a repeating pattern having a pair of nickel plated copper strands 48*a* adjacent to a pair of stainless steel strands 48*b*. All strands are number 32 AWG producing a lead wire of number 20 AWG.

Physical Property Advantages of the Prophetic Examples

By positioning stainless steel strands such as 48*b* and 48*c* in the outer layer 46 of the above-described example lead wires, the tensile strength and fatigue life of the example lead wires are superior to many commonly used prior art lead wires. A fatigue life greater than 6,000 cycles and an increase in tensile strength of about 20% over prior art lead wires are achieved.

Figure 5:
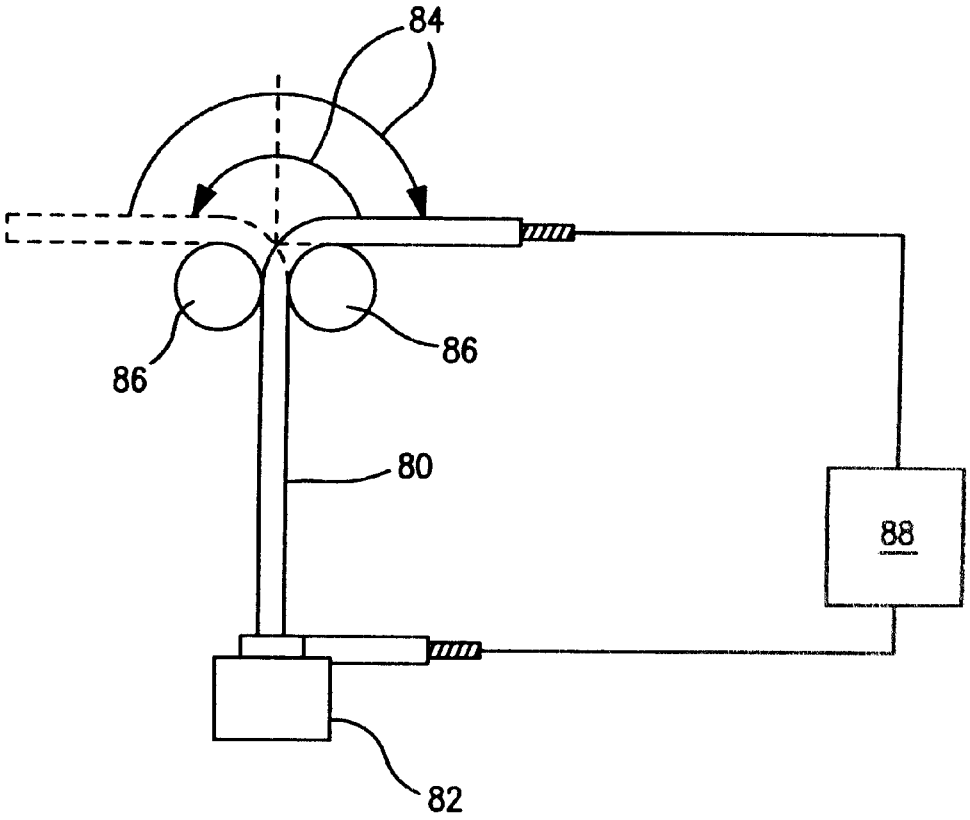
FIG. 5 shows a schematic diagram of a bending test procedure.

The lead wires according to the prophetic examples described above are subjected to a tensile test (ASTM Standard D638) which determines their ultimate breaking strength and a fatigue test. In the fatigue test, illustrated schematically in FIG. 5, a standard length of a lead wire 80 is loaded with a weight of 82 of 500 g in tension and repeatedly bent through an angle of 180° as indicated by arrows 84. Lead wires 80 is bent over adjacent mandrels 86 having a diameter of 20 mm at a frequency of 30 cycles per minute. Mandrels 86 are spaced apart 2.2 mm for AWG 18 wire, and 2.0 mm for AWG 20 wire. The resistance of the lead wire is measured by a device 88 as the wire 80 is being bent, and the number of bending cycles is counted. The fatigue life being determined by the number of cycles required to increase the resistance of the wire by 5% above its initial value.

Breaking strength is an important characteristic of the lead wire because it is a direct measure of the robustness and durability of the wire. Wires having higher breaking strengths are desired because they will better endure the forces and abuse experienced by the wire during production and in use as described below.

The fatigue life of the examples wires are significantly improved over many commonly used prior art lead wires. This is a surprising result which goes completely against the conventional wisdom, which teaches that an increase in fatigue life can only be obtained by increasing the number of the strands and decreasing the gage of each strand.

One explanation for the superior fatigue life of the example lead wires over the prior art wires is that the strands having the greatest stiffness and fatigue strength, i.e., the stainless steel strands 48*b* and 48*c*, are positioned outermost from the neutral axis where the stresses due to bending are greatest. Because the stainless steel strands are inherently stiffer than the copper strands they see proportionally more of the bending stresses, and because stainless steel has a greater fatigue strength they are also better able to survive multiple cycles of reverse bending stress which is damaging and leads to fatigue failure.

The fatigue life of a lead wire is an important design parameter because lead wires are typically employed in high vibration environments such as in automotive applications where they are subjected to large numbers of reverse bending stress cycles causing the fatigue life to be the controlling factor determining the operational life of the oxygen sensor in many cases.

Manufacturing Advantages

Significant manufacturing advantages are also achieved by the example lead wires according to the invention. The invention has only 19 strands comprising the wire, and this number of strands can be easily manufactured with all of the strands being laid in one pass by existing machines. Wires with greater numbers of strands must often be made in multiple passes, thus, increasing the time and cost of production.

Positioning the stainless steel in the outer layer increases the breaking force and stiffens the wire according to the invention, allowing the machines to run at higher speeds with greater force on the wire. Because the wire is stiffer and under higher tension loads, it is also less susceptible to instability failures such as birdcaging. This allows the manufacturing machines to work at the higher speeds with less tendency for individual strand failure, breakage and stripping away due to the "high strand" problem described above, resulting in fewer production line interruptions, less scrap and higher efficiency of production.

Stainless steel in the outer layer also helps protect the wire when the protective sheath 24 is applied in the manufacturing process. Sheath materials, such as PTFE, are applied at relatively high temperatures on the order of 350° C. and exude fluorocarbon gases which combines with hydrogen in the moisture in the air to produce hydrofluoric acid. The acid will attack and pit metals such as copper, which must be nickel plated for protection. The stainless steel resists the acid, thus, it need not be plated, thereby eliminating a step in the manufacturing process, and decreasing the overall cost of the wire. Because the wire according to the invention has a higher breaking strength it can be pulled through the sheathing process at higher forces and greater speeds, thus, increasing the rate of production.

Advantages During Use

The example lead wires according to the invention also provide significant advantages during use. The stainless steel in the outer layer acts as armor which provides a tough outer layer with low notch sensitivity. The stainless steel strands effectively resist nicks, cuts, dents, cracks and any other physical damage which might occur during manufacture, installation or in operation and would otherwise result in stress risers being formed on the strands. As explained above, stress risers serve as crack initiation points from which cracks propagate and lead to premature fatigue failure of the wire. Crimping operations can be especially damaging to the softer strands comprising traditional lead wires and can lead to rapid fatigue failure at or near the crimp. By positioning the tough stainless steel wires in the outer layer, damage to the strands is less likely to occur and the softer nickel plated copper strands are protected against the crushing forces imposed by the crimping operation.

Positioning the inherently stiffer stainless steel strands in the outer layer also increases the section modulus of the wire and places strands in outer layer which have a higher yield stress than nickel plated copper. This combination of higher section modulus and higher yield strength in the outer layer reduces the propensity of the wire to take a curved permanent set when stored wrapped around a spool or drum. This is important during the crimping operation because the wire must be straight for the crimping machines to work efficiently and avoid misfeeds.

Many prior art lead wires of nickel plated copper have a relatively low yield stress and consequently take a significant permanent set when they are stored wound around a spool after manufacture and before use. The permanent set causes such wires to remain in a curved shape when they are unwound from the spool. The curved wires must be straightened prior to being fed to the crimping machines if wire misfeeds which disrupt the production line are to be avoided. However, the straightening process adds a step to the assembly procedure, increasing cost and slowing the procedure down and can damage the wire by breaking the adhesive bond between the wire strands and the insulating sheath. If the bond between the sheath and strands is broken, then when the wire is stripped to form the various electrical connections necessary for operation of the oxygen sensor the entire length of sheath may come off the wire, rendering it useless. The wires according to the invention tend not to take a curved permanent shape when wrapped around a spool, therefore, minimizing the force required to straighten the wire or entirely eliminating the need to straighten the wire at all for crimping, thus, avoiding the disadvantages associated with that operation such as misfeeds of the crimping machines. The crimping process can be run at higher speed, and there is less waste and greater production efficiency because the bond between the insulation sheath and the strands is not disrupted, allowing effective stripping of the wire as required for effecting electrical connections.

Because of the higher breaking force and fatigue life, the wires according to the invention can better endure rougher handling during installation in a vehicle and the harsh environment encountered in everyday use. The steel protects the softer, weaker copper strands, takes a greater proportion of the tension forces and stresses due to vibration or relative movement between the different parts of the vehicle to which the wire is attached, while the copper strands provide superior conductivity for carrying electrical current for signals and heating elements as typically found in oxygen sensors.

The oxygen sensor lead wire according to the invention provides a wire with significant advantages over many prior art lead wires in terms of tensile strength, fatigue life and manufacturing speed while also being significantly less expensive and easier to produce than wire designs using more than 19 strands to achieve increased fatigue life.

What is claimed is:

1. A lead wire for use with an oxygen sensor, said lead wire comprising:

an elongate center strand having a relatively high tensile strength;

a first plurality of elongate strands, each having a relatively high electrical conductance, said strands of said first plurality being arranged circumferentially around said center strand;

a second plurality of elongate strands having a relatively high electrical conductance;

a third plurality of elongate strands having a relatively high tensile strength, strands of said third plurality comprising a first material; and a fourth plurality of elongate strands having a relatively high tensile strength, strands of said fourth plurality comprising a second material different from said first material, said strands of said second, third, and fourth pluralities being arranged circumferentially around said first plurality of strands in a repeating pattern wherein each strand of said second plurality is positioned substantially between a strand of said third plurality and a strand of said fourth plurality.

2. A lead wire according to claim 1, wherein said first material is hard stainless steel and said second material is soft annealed stainless steel.

3. A lead wire according to claim 2, wherein said strands of said first and second pluralities comprise a copper alloy.

4. A lead wire according to claim 3, wherein said center strand comprises stainless steel.

5. A lead wire according to claim 4, wherein all of said strands have a gage of about #32 AWG.

6. A lead wire according to claim 5, wherein said first and second pluralities each comprise six strands.

7. A lead wire according to claim 6, wherein said third and fourth pluralities each comprise three strands.

8. A lead wire according to claim 4, further comprising an elongate tubular sheath of an insulating material circumferentially surrounding said second, third and fourth pluralities of strands, said sheath having a plurality of passages extending lengthwise therethrough allowing the passage of gases through said sheath to said oxygen sensor.

* * * * *